United States Patent [19]

Sugimoto et al.

[11] 4,455,818

[45] Jun. 26, 1984

[54] APPARATUS FOR MANUFACTURING FLAT TWISTED CABLE

[75] Inventors: Yasuo Sugimoto; Masami Maeda; Hiroshi Ishimura; Satoshi Saito; Koichi Chinone, all of Ibaraki, Japan

[73] Assignee: Hitachi Cable Ltd., Tokyo, Japan

[21] Appl. No.: 366,613

[22] Filed: Apr. 8, 1982

[30] Foreign Application Priority Data

Jul. 1, 1981 [JP] Japan ..... 56-102752

[51] Int. Cl.[3] ..... H01B 13/04; H01B 13/06

[52] U.S. Cl. ..... 57/293; 57/204; 57/297; 174/117 F

[58] Field of Search ..... 57/204, 206, 293, 294, 57/295–297; 156/55, 436; 174/34, 117 F

[56] References Cited

U.S. PATENT DOCUMENTS

| | | | |
|---|---|---|---|
| 3,320,350 | 5/1967 | Corrall et al. | 57/293 |
| 3,434,275 | 3/1969 | Backer et al. | 57/293 X |
| 3,545,194 | 12/1970 | Fish et al. | 57/293 |
| 3,559,390 | 2/1971 | Staschewski | 57/293 X |
| 4,034,148 | 7/1977 | Lang | 174/117 F X |
| 4,096,006 | 6/1978 | Paquin | 156/55 |
| 4,142,355 | 3/1979 | Chambley et al. | 57/293 |
| 4,173,115 | 11/1979 | Chambley et al. | 57/293 |
| 4,202,722 | 5/1980 | Paquin | 156/436 |
| 4,381,426 | 4/1983 | Cronkite et al. | 57/204 X |
| 4,413,469 | 11/1983 | Paquin | 57/293 |

*Primary Examiner*—John Petrakes

*Attorney, Agent, or Firm*—Sughrue, Mion, Zinn, Macpeak and Seas

[57] ABSTRACT

The apparatus provides for continuously manufacturing a flat twisted cable composed of a plurality of single-conductor pairs having alternate oppositely directed twisted portions with straight portions therebetween. The apparatus has a multi-stage single-conductor pair supply unit, a twisting unit, a reciprocatingly movable untwist preventing unit, a lateral spacing and converging unit, a reciprocating movable welding unit, and a take-up unit. The untwist preventing unit has piston operated pins for preventing the propagation of the twist from the preceding and following twisted portions of the flat twisted cable to the straight portions of the single-conductor pairs thereof. The welding unit has a reciprocatingly movable welder. The welding unit commences movement together with the straight portion when the latter reaches a position within the welder which performs the high frequency induction welding of the insulation coverings of straight portions to each other during movement. Thus, the flat twisted cable can be continuously manufactured automatically with a relatively small-sized apparatus.

10 Claims, 17 Drawing Figures

APPARATUS FOR MANUFACTURING FLAT TWISTED CABLE

BACKGROUND OF THE INVENTION

The present invention relates to an apparatus for manufacturing a flat multi-conductor cable. More particularly, the invention relates to an improvement in an apparatus for manufacturing a flat multi-conductor cable having laterally aligned twisted and straight portions at predetermined and periodic intervals.

A conventional flat multi-conductor cable having laterally aligned alternating twisted and straight portions at predetermined and periodic intervals was disclosed, for example, in U.S. Pat. No. 4,096,006 entitled "METHOD AND APPARATUS FOR MAKING TWISTED PAIR MULTI-CONDUCTOR RIBBON CABLE WITH INTERMITTENT STRAIGHT SECTIONS" and issued to Patrick Joseph Paquin on June 20, 1978. The flat multi-conductor cable disclsed in this patent is constructed to have a plurality of twisted insulated conductor pairs in combination with intermittent straight sections laminated therein at precise lateral spacings. A plurality of conductor pairs are maintained at lateral spacings by alternately laminating the twisted portions of the conductors and the straight portions of the conductors, between upper and lower plastic films with both the upper and lower plastic films being subsequently heat welded under pressure to each other on either side of the conductors. Since such a conventional flat multi-conductor cable maintains the precise lateral spacings between the conductor pairs by heat welding under pressure between upper and lower plastic films laminated on either side of the conductors pairs, it is relatively difficult to maintain the flatness of the flat multi-conductor cable in the lateral spacings between the conductor pairs. This inconveniently introduces an uncertainty to the arrangement of connectors for the flat multi-conductor cable. Further, the twisted portions of the conductor pairs of the flat multi-conductor cable have reduced flexibility due to the presence of the plastic films laminated on both sides of the conductor pairs which causes considerable inconvenience when being used in a limited space.

It has been proposed to eliminate this inconvenience by having a flat twisted cable which does not employ such lamination of plastic films but which only heat welds the insulative coatings of single-conductors in the straight portion to each other, thereby providing excellent flatness of the straight portion while keeping the twisted portion highly flexible.

Such a conventional flat twisted cable is manufactured by passing a plurality of single-conductor pairs through a twister formed of tubular or straw dies with the nozzle outlets of the straw dies being disposed in a common horizontal plane while suitably laterally converging the single-conductor pairs, alternately twisting the conductor pairs clockwise and counterclockwise with non-twisted portions of the single-conductor pairs coated between the twisted portions, temporarily terminating the forward travel of the conductor pairs when the straight portion of the conductor pairs reaches a heat welding section disposed at a predetermined position and heat-welding the conductor pairs of the straight portions of the flat cable therebetween. Since the manufacture of such a conventional flat twisted cable is intermittent, the manufacturing speed is low and problems arise with respect to the uniformity of the products. Inasmuch as the apparatus for manufacturing the conventional cable operates intermittently, the maintenance of the apparatus is relatively difficult. In addition, the apparatus is relatively complicated and excessively large when the whole operation of the apparatus is to be automated.

Moreover, in a conventional apparatus for manufacturing a flat cable, in order to overcome the problem of converging single-conductor pairs toward each other during a period from the step of deriving the single-conductor pairs from the bobbins to the step of heat welding and the problem of effectively heat welding the straight portions of the conductor pairs in the step of heat welding, the conductor pairs of the cable are normally roughly converged by using springs. Subsequently the conductor pairs thus roughly converged are supported by a double fork device. Thereafter the pairs are converged further toward each other in a predetermined width and the conductor pairs thus further converged are eventually converged even further by a single-fork device. Since it is necessary to provide sufficient space so as to converge the conductor pairs in such a multiple step operation, such a conventional apparatus inevitably must increase in size.

SUMMARY OF THE INVENTION

Accordingly, a primary object of the present invention is to provide an apparatus for manufacturing a flat twisted cable continuously which is relatively small in size and in which all of the above-described difficulties accompanying a conventional apparatus for manufacturing a flat twisted cable are eliminated.

Another object of the invention is to provide an apparatus for continuously manufacturing a flat twisted cable in which the flatness can be readily maintained at the straight portions of the conductor pairs of the cable thereby making it possible to easily arrange connectors for the conductors.

A further object of the invention is to provide an apparatus for continuously manufacturing a flat twisted cable in which flexibility is increased in the twisted portions of the conductor pairs of the cable thereby enabling the use of the cable even in a limited space.

Still another object of the invention is to provide an apparatus for continuously manufacturing a flat twisted cable in which the production is not intermittent in operation thereby manufacturing a uniform product at an accelerated speed.

A particular object of the invention is to provide an apparatus for continuously manufacturing a flat twisted cable in which all the steps of fabricating the cable can be automated.

The foregoing objects and other objects of the invention have been achieved by the provision of an apparatus for continuously manufacturing a flat twisted cable which, according to the invention, comprises a multi-stage single-conductor pair supply means, a twisting means, a reciprocatingly movable untwist preventing means, a lateral spacing and converging means, a reciprocatingly movable welding means, and a take-up means. The single-conductor pair supply means comprises a plurality of single-conductor reels and a unit for introducing or passing the single-conductor pairs in parallel from the reels to the twisting means. The twisting means comprise multi-stage twisting straw or tubular dies arranged in a horizontal plane at the respective outlet nozzles thereof. The untwist preventing means comprises a unit for selectively inserting pins vertically between the single-conductors of each conductor pair at both ends of the straight portions of the single-conductor pairs of the flat cable to prevent the propagation of the twist from the preceding and the following twisted portions of the flat cable to the straight portions thereof emerging from the outlet nozzles of the respective dies. The lateral spacing and converging means is movable longitudinally along the conductor pairs and comprises a plurality of single forks for receiving the straight portions from the untwist preventing means while allowing the straight portions to move only in a horizontal direction so that the conductor pairs of the straight portions can be converged with tension applied to the single-conductor pairs. The welding means comprises a reciprocatingly movable welder which commences its movement simultaneously upon arrival of the straight portions of the single-conductor pairs of the flat cable and welds the insulative coatings of the adjacent conductor pairs of the straight portions to each other during the movement without disturbing the continuous movement of the straight portions of the flat cable. Further, the take-up means comprises a pair of pinch rollers for driving the flat cable being manufactured.

The nature, principle and utility of the invention will become more apparent from the following description when read in conjunction with the accompanying drawings.

DESCRIPTION OF THE PREFERRED EMBODIMENTS

Figure 1:
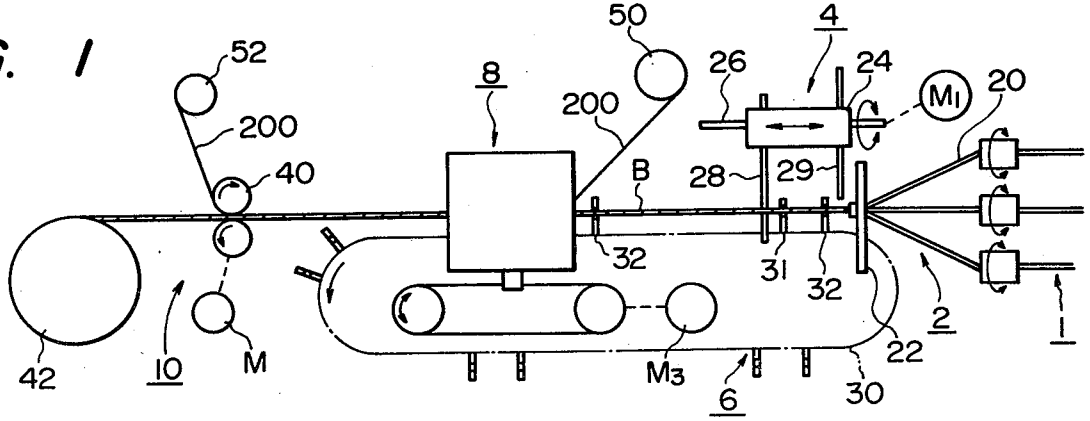
FIG. 1 is a schematic side view of a preferred embodiment of an apparatus for manufacturing a flat twisted cable according to the invention.
Figure 2:
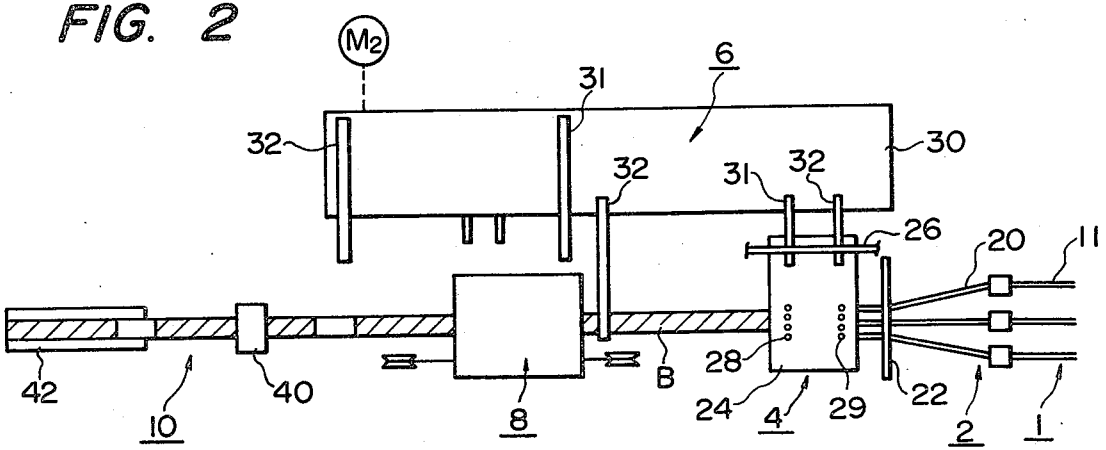
FIG. 2 is a plan view of the apparatus shown in FIG. 1.

A preferred embodiment of an apparatus for consecutively manufacturing a flat twisted cable according to the invention is shown in FIG. 1, in which like reference numerals designate the equivalent or the same units, components and parts in other views. FIG. 2 shows a plan view of the apparatus shown in FIG. 1.

In FIGS. 1 and 2, the apparatus constructed according to the invention comprises essentially a multi-stage single-conductor pair supply unit 1, a twisting unit 2, a reciprocatingly movable untwist preventing unit 4, a lateral spacing and converging unit 6, a reciprocatingly movable laminating means 8 and a take-up unit 10.

Figure 3:
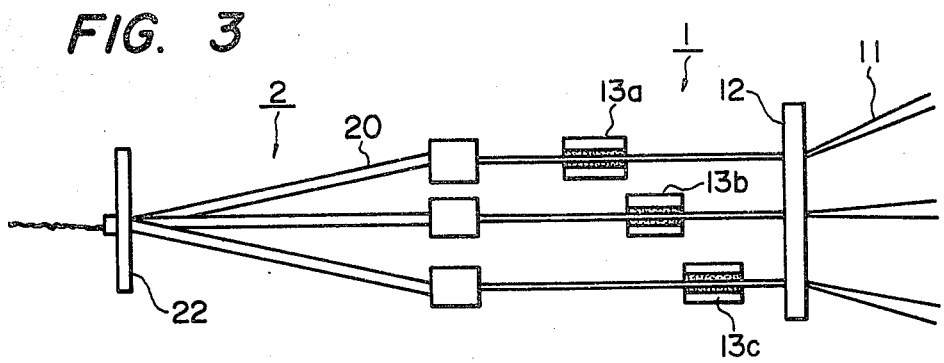
FIG. 3 is a schematic side view of the twisting unit of the apparatus shown in FIG. 1.
Figure 4:
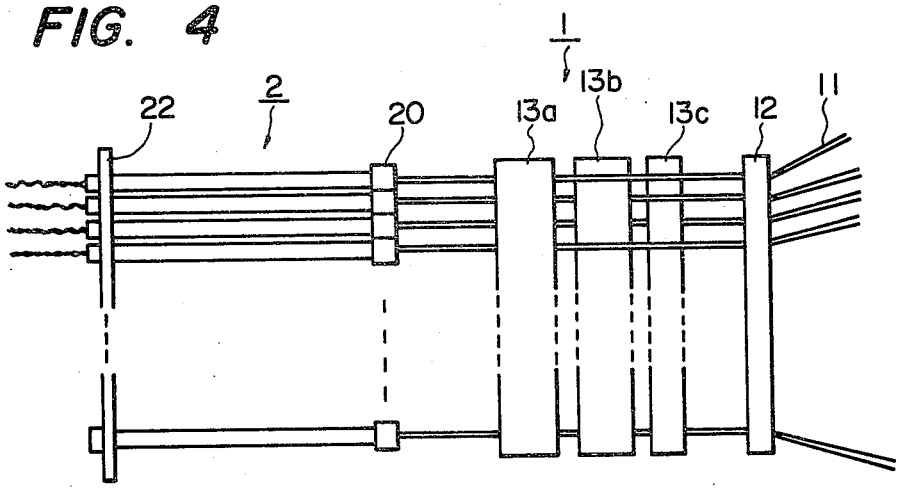
FIG. 4 is a plan view of the twisting unit shown in FIG. 3.

An example of a single-conductor pair supply unit 1 is shown in FIGS. 3 and 4 in side and plan views, respectively, wherein the single-conductor pair supply unit 1 comprises an apertured plate or butt strap 12 having a predetermined number of openings arranged in multiple stages (three stages in the example shown in FIGS. 3 and 4) for aligning, in parallel, a plurality of single-conductor pairs 11 each having two insulated conductors derived from a plurality of single-conductor supply bobbins (not shown) and a plurality of felt plates 13*a*, 13*b* and 13*c* arranged longitudinally at the respective stages for maintaining in parallel with each other the single-conductor pairs 11 from the apertured plate 12 and guiding the single-conductor pairs 11 under a predetermined tension into the twisting unit 2.

The twisting unit 2 comprises a plurality of tubular or straw dies 20 for guiding the conductor pairs to the outlet nozzles thereof while twisting the respective pairs and a support plate 22 for aligning the outlet nozzles of the dies 20 in a horizontal plane. The tubular dies 20 are rotatably driven by a suitable reversible drive mechanism (not shown) in a conventional manner as disclosed in the aforementioned patent. The die drive mechanism rotates the dies 20 clockwise and counterclockwise alternatively over predetermined time periods, respectively, with a non-rotation period between the clockwise and counterclockwise rotations thereby twisting the single-conductor pairs passing therethrough, with non-twisted, straight portions between the adjacent twisted portions of the single-conductor pairs, resulting in a plurality of parallel conductor pairs each having straight portions between adjacent twisted portions. It is important in this preferred embodiment of the invention, as shown in FIGS. 1 through 4, that the outlet nozzles of the tubular dies 20 are aligned within a horizontal plane at the support plate 22.

The untwist preventing unit 4 serves to prevent the twist of the twisted portions of the single-conductor pairs from propagating to the straight portions therebetween when forming the latter.

Figure 5:
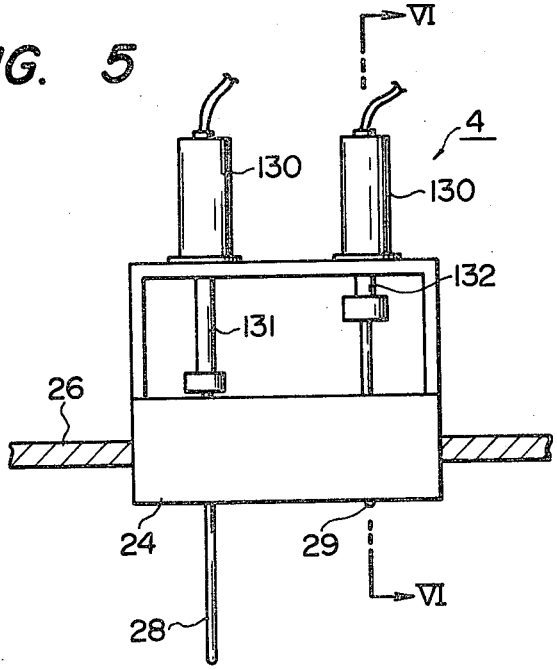
FIG. 5 is a schematic side view of the untwist preventing unit of the apparatus shown in FIG. 1.
Figure 6:
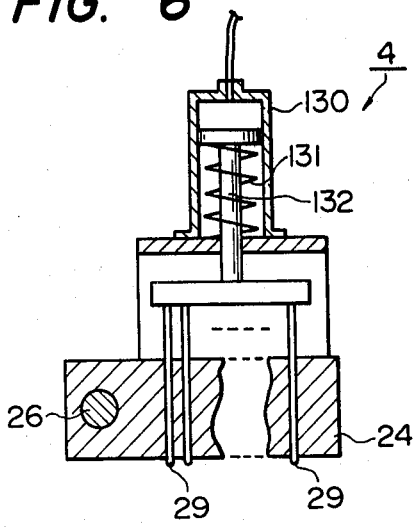
FIG. 6 is a partial cross sectional view taken along the line VI—VI in FIG. 5.

FIG. 5 shows schematically one preferred example of the untwist preventing unit 4 in a perspective view and FIG. 6 shows a cross sectional view of the untwist preventing unit 4 taken along the line VI—VI in FIG. 5. As shown in FIGS. 5 and 6, the untwist preventing unit 4 comprises a support base 24, which is reciprocatingly driven by a lead screw 26 driven by a suitable reversible motor $M_1$ (FIG. 1). The support base 24 is provided with two rows of a plurality of penetrating holes. The number of holes in each row is equal to that of the single conductor pairs with the spacing therebetween substantially equal to that between the single-conductor pairs emerging from the tubular dies 20. The rows of holes are spaced at an interval substantially equal to the length of the straight portions of the parallel single-conductor pairs. Pins 28 in one row and pins 29 in another row are vertically movable in the penetrating holes of the base 24. The pins 28 and 29 are supported by block 27 in parallel. A cylinder 130 is provided for each row of pins 28 and 29. Each cylinder 130 includes a piston 132 biased upwardly by a spring 131. Each piston 132 is connected to the block 27 supporting the pins 28 or 29. The upper end of the cylinder 130 in each row is connected through a suitable conduit to a pressure source (not shown). The pressure source is normally deenergized and when the pressure source is energized, hydraulic pressure is selectively applied to one or both of the cylinders 130, thereby extending the pins 28 and/or 29 downwardly from the base 24.

Figure 7:
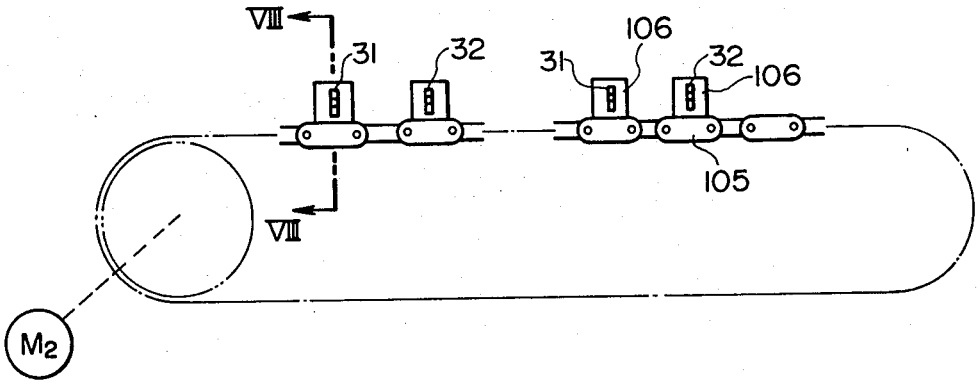
FIG. 7 is a schematic side view of the lateral spacing and converging unit of the apparatus shown in FIG. 1.

The lateral spacing and converging unit 6 comprises, as shown in FIG. 7, an endless belt and a suitable drive unit $M_2$ for driving the belt composed of a plurality of carriages 105. The belt is continuously driven at speed equal to that of the flat cable by the drive unit $M_2$. The unit 6 further comprises a plurality of fork supports 106 each of which is secured on one of the carriage 105.

Figure 8:
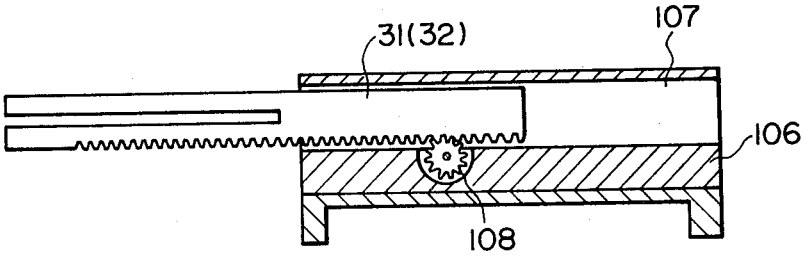
FIG. 8 is a cross sectional view taken along the line VIII—VIII in FIG. 7.

As indicated in FIG. 8 which is a partial cross sectional view taken along the line VIII—VIII in FIG. 7, each fork support unit 106 comprises a support member 106 fixed to the carriage 105, a guide portion 107 formed in the support member 106, a fork 31 or 32 movable within the guide portion 107 of the support member 106, and a drive mechanism 108 having a rack formed on the fork and a pinion 108 engaged with the rack of the fork and supported on the support member for driving the fork 31 or 32 laterally. The pinion 108 is driven by a suitable drive unit (not shown). More specifically, when a pinion 108 is rotatably driven in a forward direction, the respective fork is projected from the fork support unit 106 to allow the fork to nip the straight portions of the parallel single-conductor pairs in a slot formed at the end of the fork. The slot of the fork is so formed in width as to be slightly wider than the diameter of the single-conductor so that the single-conductors of the straight portions can move laterally within the slot.

Figure 9:
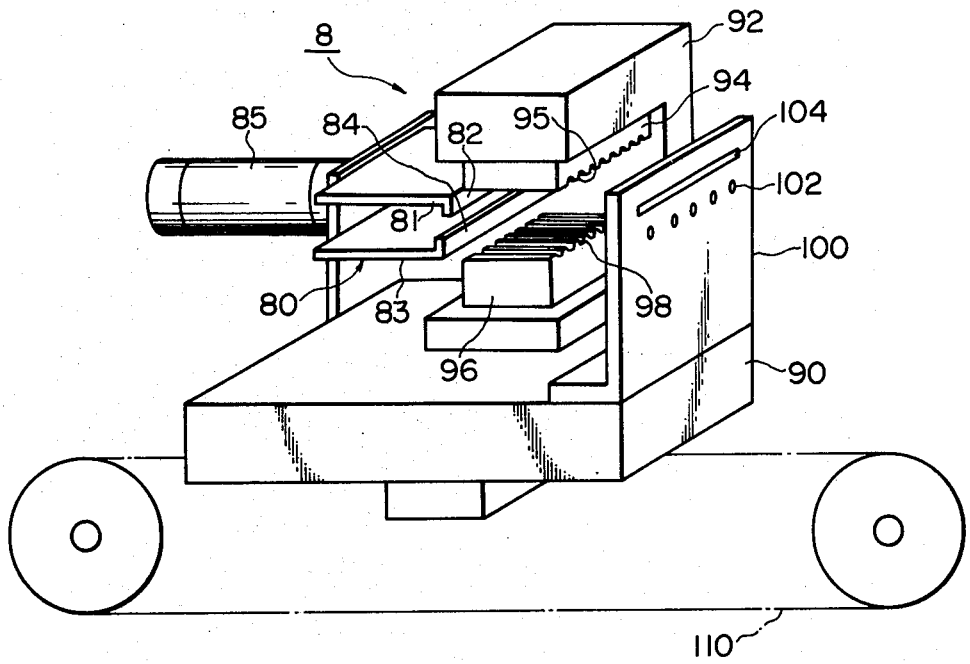
FIG. 9 is a schematic perspective view of one row of the heat laminating unit of the apparatus shown in FIG. 1.

FIG. 9 is a schematic perspective view of one preferred example of the welding unit 8. The welding unit 8 comprises a support base 90 which is so mounted on a frame (not shown) of the apparatus of the invention as to be movable along with the straight portion of the flat cable at a speed equal to that of the flat cable in a forward direction during the welding period. The base 90 is carried, for example, by an endless belt 110 driven in forward and reverse directions by a reversible motor $M_3$. The welding unit 8 also comprises a butt strap or perforated plate 100 fixedly provided on one end of the base 90. The plate 100 has a plurality of penetrating holes 102 for passing the converged single-conductor pairs while maintaining the single-conductor pairs in parallel. The perforated plate 100 also has a horizontally elongated opening 104 above the penetrating holes 102, which opening 104 will be described later. A wiping unit 80 is so arranged behind the plate 100 as to be movable laterally between an upper electrode 94 supported by a support post 92 and a lower electrode 96 by a suitable hydraulic unit 85. The electrodes 94 and 96 are movable with respect to each other.

The wiping unit 80 includes a pair of gripping members 81 and 83 which have gripping ends 82 and 84, respectively formed along one edge. The gripping members 81 and 83 are normally biased such that the gripping ends 82 and 84 are spaced apart and are disposed in the space between the upper electrode 84 and the lower electrode 86. When the hydraulic unit 85 is energized, the gripping ends 82 and 84 of the gripping members 81 and 83 are brought together, are maintained closed for a time and are thereafter opened. In this manner the parallelism of the straight portions of the single-conductor pairs passed through the penetrating holes 102 of the perforated plate 100 can be again adjusted before the step of welding thereof. This mechanism can be arbitrarily selected and employed for performing the aforementioned operation in the apparatus of the invention and may be readily designed by those skilled in the art. The spacing between the gripping ends 82 and 84 of the gripping members 81 and 83, when closed, may be set substantially equal to the diameter of a single conductor of the straight portions of the single-conductor pairs.

The take-up unit 10 comprises a pair of pinch rollers 40 which drivingly pull the single-conductor pairs of the flat cable under a predetermined tension.

Plastic sheet or film may be arranged at the welding unit 8 to be put on the single-conductor pairs thus fed so as to uniformly and effectively weld the single-conductor pairs. In this preferred embodiment, a plastic sheet 200 is supplied from a supply roll 50 (FIG. 1) through the horizontally elongated opening 104 of the perforated plate 100 so that the plastic sheet is superposed on the single-conductor pairs aligned in parallel when the upper and lower electrodes 94 and 96 are closed. Thereafter, the plastic sheet is moved together with the single-conductor pairs, is separated therefrom after passing the pinch rollers 40, and is taken up on take-up reel 52 (FIG. 1).

The operation of the apparatus for continuously manufacturing a flat twisted cable thus-constructed will be described with reference to FIGS. 10A through 10D and 11.

Figure 10A:
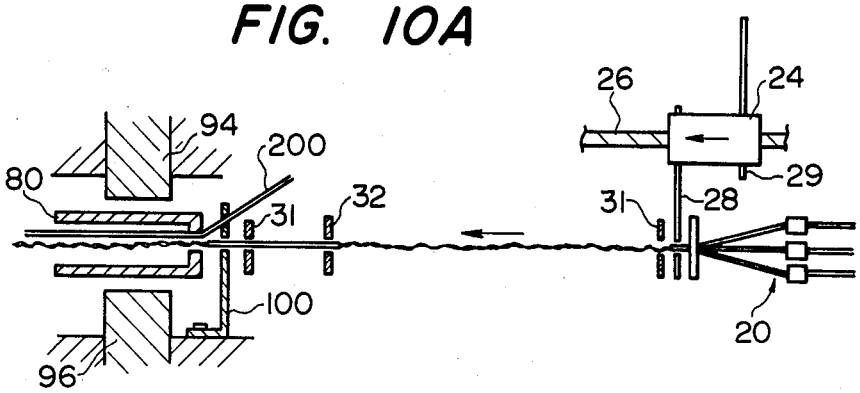
FIGS. 10A through 10D are explanatory views exemplifying the operation of the apparatus shown in FIG. 1.
Figure 10B:
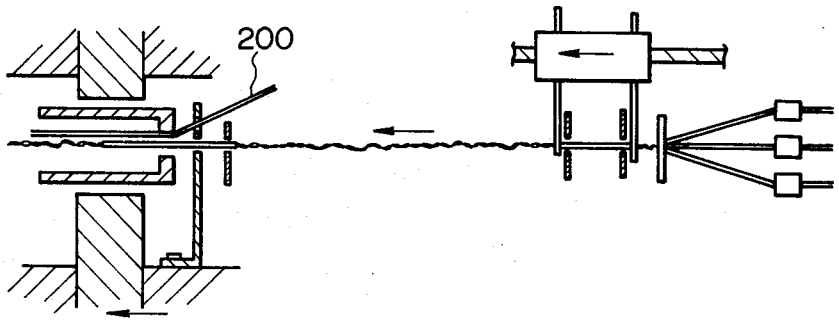
Figure 10C:
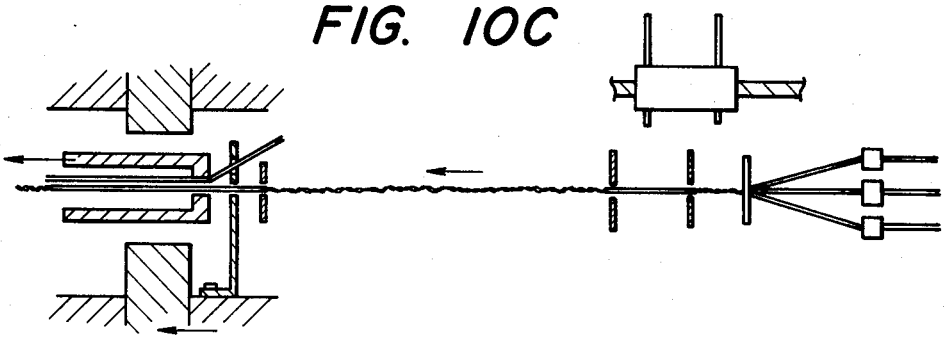
Figure 10D:
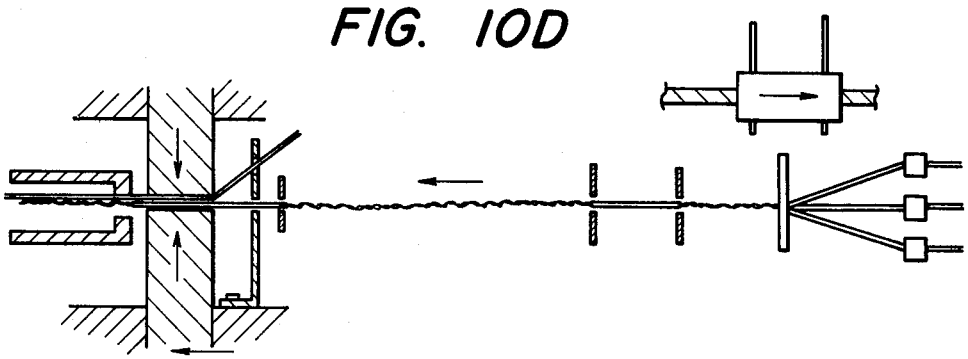
Figure 11:
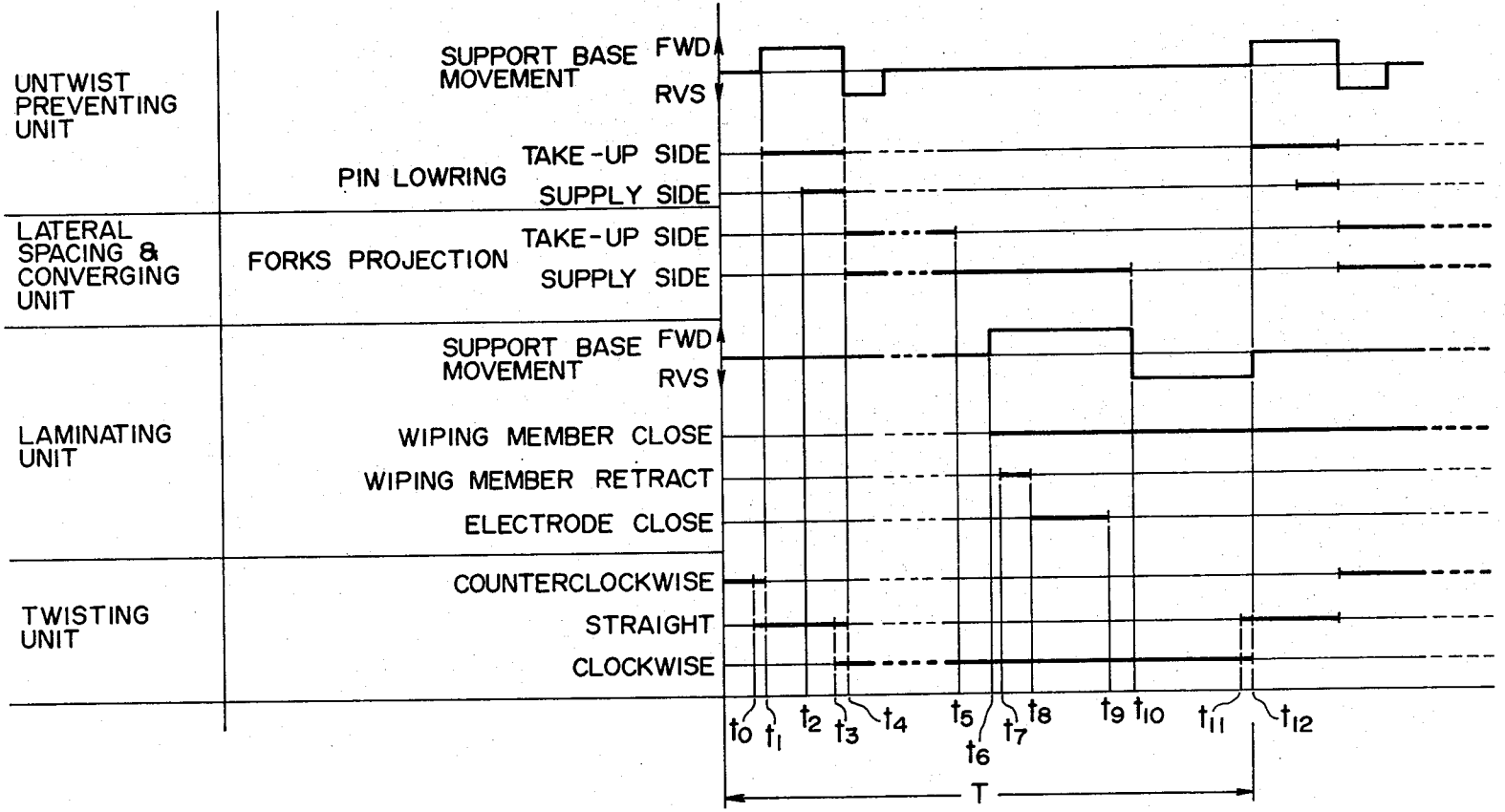
FIG. 11 is a timing chart of the operation of the apparatus shown in FIG. 1.

FIGS. 10A through 10D show the operations of the respective units 2 through 8 of the apparatus of the invention upon movement of the single-conductor pairs therethrough, and FIG. 11 is a timing chart for the respective units of the apparatus.

The operation of the apparatus will be first described mainly at the untwist preventing unit 4 and the lateral spacing and converging unit 6.

FIG. 10A shows parallel single-conductor pairs being continuously manufactured while being pulled through the apparatus by the pinch rollers 40 (FIG. 1) and shows the state where the straight portions of the single-conductor pairs emerge at the outlet nozzles of the tubular dies 20 of the twisting unit 2. This state occurs at a time $t_1$, in FIG. 11, slightly subsequent to the time $t_0$ at which the rotation of the dies 20 in either direction is terminated. In this state, the support base 24 of the untwist preventing unit 4 is at the rightmost position nearest to the dies 20. At this time, the cylinder 130 at the take-up side is hydraulically energized to lower the pins 28 of take-up side such that each of the pins 28 is inserted into the space between the single-conductors in each pair at the starting end of the straight portion to thereby prevent the twist of the twisted portion preceding the straight portion from propagating to the straight portion. At the same time the base 24 commences to move forwardly at a speed equal to that of the straight portions of the single-conductor pairs by the forward rotation of the drive unit $M_1$. This operation continues up to a time $t_4$ at which the rear end of the straight portion emerged from the outlet nozzles of the dies 20 has moved a predetermined distance from the nozzles.

At the time $t_2$, the cylinder 130 at the supply side is hydraulically energized to thereby lower the piston and pins 29 such that each of the pins 29 is inserted into the space between the single-conductors in each pair at the end of the straight portion. Thus, this operation serves to prevent the twist of a following twisted portion from propagating to the preceding straight portions. At the time $t_4$, when the base 24 completes its movement by the distance with the pins 28 and 29 being lowered, the forks 31 and 32 are simultaneously fed, as shown in FIG. 10B, by the rack and the pinion of the drive mechanism 108 to receive the both end portions of the straight portions within the slots thereof. Simultaneously with this operation, both cylinders 130 are de-energized and the pins 28 and 29 are retracted, as shown in FIG. 10C, by the springs provided thereat. At this time the lead screw 26 starts to rotate in the reverse direction, and accordingly the base 24 is returned, as shown in FIG. 10D, to the original position. The rotation speed of the lead screw 26 in the reverse direction may be higher than that in the forward direction.

Figure 12:
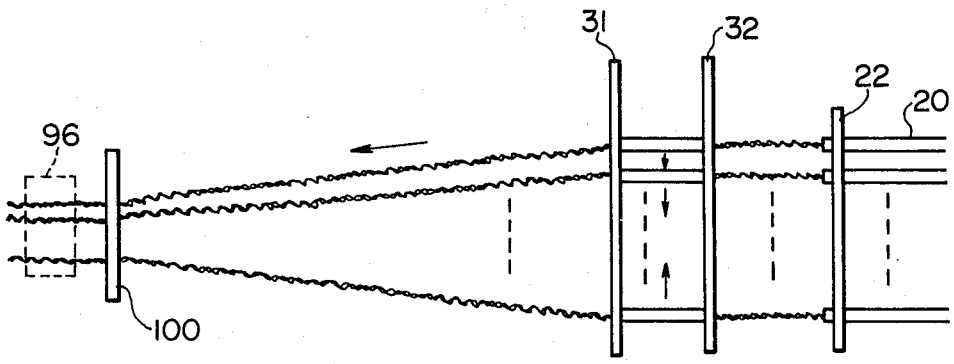
FIG. 12 is an explanatory view exemplifying the lateral spacing and converging operations of the unit shown in FIG. 7.

In this state, the reversely twisted portions of the single-conductor pairs following the straight portions emerge from the outlet nozzles of the tubular dies 20 by means of the tension applied on the cable by the pinch rollers 40, and the forks 31 and 32 are moved along with the straight portions at a speed equal to the straight portions, while holding the straight portions of the single-conductor pairs as shown in FIG. 12.

As described above, the slots of the respective forks 31 and 32 are so formed in width as to be slightly larger than the diameter of the single-conductor so that the single-conductor may laterally move within the slots of the forks due to the applied tension. Accordingly, the single-conductor pairs are gradually gathered at one step during the travel toward the perforated plate 100 of the welding unit 8.

The foregoing description is directed to a combination of the operations of the apparatus mainly at the untwist preventing unit 4 and the lateral spacing and converging unit 6. A combination of the operations of the lateral spacing and converging unit 6 and the welding unit 8 will be now described in the same manner as before with reference to the left-side portions in FIGS. 10A through 10D.

FIG. 10A shows the situation where the welding unit 8 is kept stationary while the cable is moving, the upper and lower electrodes 94 and 96 as well as the wiping unit 80 are opened so that the parallel single-conductor pairs may freely pass therebetween and the forward ends of the straight portions held between the forks 31 and 32 reach the perforated plate 100 of the stationary welding unit 8. This state corresponds to that at a time $t_5$ in FIG. 11.

When the forward ends of the straight portions enter into the holes 102 of the perforated plate 100, the forward fork 31 is retracted as shown in FIG. 10B. At a time $t_6$ when the fork 32 holding the rear end portions of the straight portions reaches the porous plate 100, the welding unit 8 starts to move along with the straight portions of the single-conductor pairs by energization of the drive unit $M_3$.

Simultaneously upon the commencement of the movement of the straight portions, the wiping members 80 are closed. Shortly thereafter, the closed wiping members 80 are driven toward the take-up direction at $t_7$ as shown in FIG. 10C. This operation serves to prevent the propagation of the twistings of the preceding twisted portions to the straight portion due to the removal of the forward fork 31, as shown in FIG. 10C.

Figure 14:
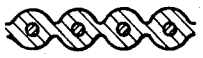
FIG. 14 is a cross sectional view of the straight portions welded according to the invention.

Thereafter, at a time $t_8$, the wiping unit or members 80 is opened and the upper and lower electrodes 94 and 96 are closed under a predetermined pressure up to a predetermined time $t_9$, as shown in FIG. 10D. In the meantime, high frequency electric energy is applied between electrodes in the welding unit 8, to thereby induction-welding the insulative coatings of the straight portions of the single-conductor pairs as shown in FIG. 14.

Figure 13:
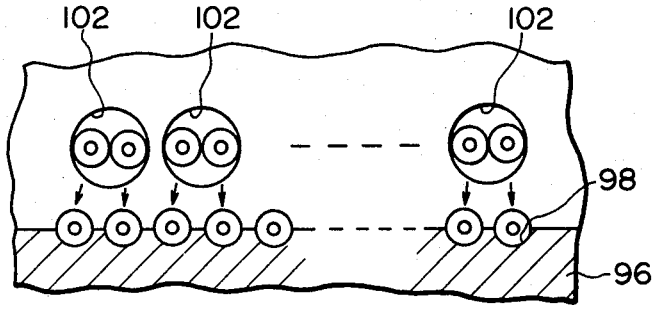
FIG. 13 is an explanatory view showing the relationship between a butt strap and the grooves of a mold in the laminating unit of the apparatus.

FIG. 13 shows a desired positional relationship between the penetrating holes 102 of the perforated plate 100 and the grooves 98 of the electrode 96 so that the single-conductors of the straight portions of the single-conductor pairs passed through the penetrating holes 102 of the perforated plate 100 may be correctly positioned in the grooves 98 of the electrode 96 of the welding unit 8 before the electrodes are closed to weld.

It should be noted that the correct engagement of the single-conductors of the straight portions with the grooves 98 of the electrodes 94 and 96 can be provided by disposing the upper surface of the lower electrodes 96 in the closed state slightly higher than the position of the penetrating holes 102 of the perforated plate 100.

At a time $t_9$, the electrodes 94 and 96 are opened upon the completion of the welding of the straight portions of the single-conductor pairs in the welding unit 8. Shortly thereafter, the forward movement of the welding unit 8 is terminated, the fork 32 is retracted and subsequently the drive unit $M_3$ is reversely operated, to thereby move the welding unit 8 to its original position in a reverse direction. It is preferred, for example, that nozzles directed toward the electrodes are provided in the welding unit and that cooling air is blown from the nozzles upon opening of the electrodes to cool the electrodes.

As described above, the welding of the straight portions of the single-conductor pairs is completed within a period T. This cycle is repeated consecutively to manufacture a flat twisted cable having alternating twisted and straight portions. The flat cable thus-manufactured is taken up on a take-up reel 42 through the pinch rollers 40 as shown in FIG. 1.

In FIGS. 1 and 10A through 10D, the plastic film 200 is supplied and superposed on the straight portions of the single-conductor pairs through the horizontally elongated opening 104 of the perforated plate 100 in the welding unit 8, and is taken adjacent the pinch rollers 40. This serves to uniformly weld the straight portions of the single-conductor pairs of the flat cable between the electrodes 94 and 96 but may be omitted within the scope of the invention.

The drive control mechanism for the twisting unit 2, untwist preventing unit 4, lateral spacing and converging unit 6 and welding unit 8 may vary, and may be readily designed and constructed by those skilled in the art.

While the invention has been described in detail with reference to a specific embodiment thereof, it will be apparent to one skilled in the art that various changes and modifications can be made therein without departing from the spirit and scope of the invention.

What is claimed is:

1. An apparatus for continuously manufacturing a flat twisted cable composed of a plurality of single-conductor pairs each having alternate oppositely directed twisted portions with straight portions therebetween, comprising:

a plurality of twisting tubular dies arranged in a plurality of stages for receiving said single-conductor pairs and for twisting the single-conductor pairs alternately in opposite directions with non-twisted, straight portions therebetween, the outlet nozzles of said tubular dies being disposed in a horizontal plane at substantially equal intervals;

untwist preventing means disposed in the vicinity of the output nozzles of said dies for preventing the propagation of the twist of said twisted portions to the straight portions of the single-conductor pairs;

lateral spacing and converging means movable along with the single-conductor pairs for receiving the straight portions of the single-conductor pairs from said untwist preventing means and carrying them while permitting a lateral convergence of the single-conductor pairs;

reciprocable welding means for welding the coatings of adjacent single-conductors to each other in the straight portions of the single-conductor pairs thus-converged and carried by said lateral spacing and converging means while moving along with the straight portions, to thereby manufacture a flat twisted cable; and take-up means for taking up the flat twisted under tension.

2. An apparatus as claimed in claim 1 in which said welding means comprises upper and lower electrodes selectively movable relative to each other, each electrode being formed with grooves for receiving the respective single-conductors of the straight portions of the single-conductor pairs upon closure thereof, a high frequency energy supply unit for supplying a high frequency energy to said electrodes when said electrodes are closed, and a perforated plate disposed in front of said electrodes and having a plurality of penetrating holes, each of said penetrating holes having a size allowing the passage of a single-conductor pair at an interval for introducing the two single-conductors of the single-conductor pair into two adjacent grooves of either of said electrodes, whereupon said welding means commences movement at an equal speed to and in the same direction as the flat twisted cable when the straight portions of the single-conductor pairs enter between said electrodes after passing perforated plate, said electrodes are closed to receive the straight portions in the respective grooves thereof and high frequency energy is applied to the straight portions thereby welding the coatings of the adjacent single-conductors to each other during the movement.

3. An apparatus as claimed in claim 2 in which said welding means further comprises further upper and lower wiping members movable between open and closed portions, said wiping members being normally open by a distance sufficiently larger than the diameter of a single-conductor and positioned between said upper and lower electrodes for allowing the passage of the single-conductor pairs, said wiping members being closed when the straight portions are positioned between said wiping members, to softly grasp the straight portions and moved rearwardly out of the electrodes to wipe said straight portions to eliminate the disorder in the parallelism of the straight portions of the single-conductor pairs and to allow the closing movement of said electrodes.

4. An apparatus as claimed in claim 1 in which said untwist preventing means comprises a support base movable in the same direction as and at an equal speed to the single-conductor pairs for a distance substantially equal to the length of the straight portions of the single-conductor pairs and thereafter reversely movable to the original position thereof, two parallel rows of pins vertically movably supported by said support base, each row having a number of pins equal to that of the single-conductor pairs and spaced apart a distance substantially equal to the spacing of the outlet nozzles of said dies and said pin rows being arranged transversely to the single-conductor pairs and spaced from each other a distance substantially equal to the length of the straight portions, and means for inserting said pins in one row in between the single-conductors of the straight portions of the respective single-conductor pairs when the ends of the straight portions emerge from the outlet nozzles of said dies and inserting said pins of the other row in between the single-conductors of the straight portions of the respective single-conductor pairs when the other ends of the straight portions emerge from the outlet nozzles of said dies to thereby prevent the propagation of the twist of the preceding and following twisted portions to each straight portion.

5. An apparatus as claimed in claim 4 in which said lateral spacing and converging means comprises a plurality of fork pairs, the distance between the forks in each pair being substantially equal to the length of the straight portion, the distance between the adjacent fork pairs being substantially equal to the length of a twisted portion, means for continuously conveying said fork pairs along with the single-conductor pairs at the same speed as the straight portions of the single-conductor pairs upon continuous movement thereof, and means for engaging said fork pairs at a predetermined time with the straight portions carried by said untwist preventing means, wherein each of the forks of said fork pairs has a slot having a width slightly larger than the diameter of a single-conductor to receive the straight portions after said pins of both rows of said untwist preventing means are inserted in between the single-conductors of the straight portions of the single-conductor pairs while allowing the movement of the straight portions in a horizontal plane within said slot thereof to converge the straight portions in a step by means of the movement of the straight portions in the horizontal plane due to the difference in distance between the outlet nozzles of said dies and said penetrating holes of said perforated plate, said pins being removed from said single-conductor pairs and untwist preventing means being returned to its original position after the single-conductor pairs are received by said forks.

6. An apparatus as claimed in claim 5 in which said continuously converging means of said lateral spacing and converging means comprises an endless belt, drive means for driving said endless belt, and a plurality of fork supports fixedly arranged on said endless belt at predetermined intervals.

7. An apparatus as claimed in claim 6 in which the fork support unit of said lateral spacing and converging means comprises a support member fixed to said endless belt and having a guide portion formed therein, the fork being movable within the guide portion of said support member, and a drive mechanism having a rack formed on the fork and a pinion engaged with the rack of said fork and supported on said support member for driving said fork laterally, said pinion being driven by drive means provided on said support unit.

8. An apparatus as claimed in claim 4 in which the support base of said untwist preventing means is movable along with the single-conductor pairs by a lead screw driven by reversible motor means.

9. An apparatus as claimed in claim 4 in which said untwist preventing means also comprises cylinder units each provided on each said pin row and having a piston connected to the pins of said pin row, said piston being biased upwardly by a spring in said cylinder unit, and the upper end of said cylinder unit being connectable to a normally deenergized pressure source, said piston being forced downwardly when said pressure source is energized.

10. An apparatus as claimed in claim 1 in which the outlet nozzles of said tubular dies are aligned with a horizontal plane at a support plate.

* * * * *